US005823667A

United States Patent [19]

Fukushima et al.

[11] Patent Number: 5,823,667

[45] Date of Patent: Oct. 20, 1998

[54] MIXER HAVING A SEGMENTED HELICAL MIXING BLADE

[75] Inventors: Takeshi Fukushima; Hisashi Yamamoto, both of Narashino, Japan

[73] Assignee: Pacific Machinery & Engineering Co., Ltd., Tokyo, Japan

[21] Appl. No.: 819,908

[22] Filed: Mar. 18, 1997

[30] Foreign Application Priority Data

Mar. 19, 1996 [JP] Japan ..... 8-063064

[51] Int. Cl.[6] ..... B28C 5/16; B01F 7/24

[52] U.S. Cl. ..... 366/65; 366/295; 366/318; 366/322

[58] Field of Search ..... 366/64–67, 102–104, 366/292–296, 309–313, 318, 321, 322, 323

[56] References Cited

U.S. PATENT DOCUMENTS

| | | | |
|---|---|---|---|
| 2,289,613 | 7/1942 | Weinreich | 366/294 X |
| 2,298,317 | 10/1942 | Smith | 366/294 X |
| 2,367,149 | 1/1945 | Smith | 366/295 X |
| 2,455,945 | 12/1948 | North et al. | 366/296 X |
| 2,564,715 | 8/1951 | North | 366/296 X |
| 4,193,696 | 3/1980 | Van Heel et al. | 366/322 X |
| 4,403,868 | 9/1983 | Kupka | 366/295 |
| 4,854,720 | 8/1989 | Schold | 366/294 |
| 5,356,215 | 10/1994 | Inoue et al. | 366/293 |
| 5,518,312 | 5/1996 | Inoue et al. | 366/293 |

FOREIGN PATENT DOCUMENTS

| | | | |
|---|---|---|---|
| 313295 | 12/1933 | Italy | 366/295 |

*Primary Examiner*—Charles E. Cooley

*Attorney, Agent, or Firm*—Kane,Dalsimer,Sullivan, Kurucz, Levy, Eisele and Richard, LLP

[57] ABSTRACT

A mixer is disclosed which allows more effectively mixing and easy maintenance. The mixer can positively and effectively mix different kinds of concrete. an inside mixing blade 18 includes first and second mixing blade elements 19, 19each provided with a supporting member 18*d* for supporting mixing blades 18*a*. The two mixing blades 18*a* are each formed in helical configuration and has greater width. the first and second mixing blade elements 19, 19 are inserted to a shaft body 17*a* as well as a spacer 17*a* and prevented from coming off the shaft body 17*a* by a end plate 17*b*. The inside mixing blade 18 is formed in helical shape of substantially 360 °. When any one of the mixing blades 18*a* is damaged, only the mixing blade element 19 having the damaged mixing blade 18*a* should be replaced with new one so that the replacement can be simply performed and the maintenance of the mixer 1 is improved.

4 Claims, 10 Drawing Sheets

MIXER HAVING A SEGMENTED HELICAL MIXING BLADE

BACKGROUND OF THE INVENTION

The present invention relates to a technical field of a mixer which is used in a plant for producing mixture such as concrete raw materials of the mixture.

Conventionally, mixing machines for mixing concrete raw materials, i.e. aggregate such as sand and gravel, cement, and water, etc., have been employed in concrete plants. As one of such mixing machines, a mixing machine having high mixing performance and high concrete producting rate has been proposed in Japanese Patent Publication No. H02-33281.

The mixing machine disclosed in the above publication comprises a forced mixing type of double shaft mixer and a pan type mixer overlaid on the forced mixing type of double shaft mixer. Concrete is produced by putting sand, primary water, cement into the upper pan-type mixer, mixing them in the first mixing step by the pan-type mixer to make cement mortar, discharging the resultant cement mortar to the lower forced mxing type of double shaft mixer, putting gravel and secondary water into the forced mxing type of double shaft mixer at the same time, and then mixing the material described above in the second mixing step by the forced mxing type of double shaft mixer.

FIG. 14 is a sectional view showing the upper pan type mixer of the mixing machine for mixture. In this drawing, reference numeral 1 designates the pan type mixer, reference numeral 2 designates a mixing vessel, reference numeral 2*a* designates a conical-shaped bottom plate, reference numeral 3 designates a cylindrical outer shaft rotatably supported by the mixing vessel 2, reference numeral 4 designates an internal shaft rotatably supported by the outer shaft 3, reference numeral 5 designates an outside mixing blade fixed to the outer shaft 3 and constituting outside mixing means, reference numeral 6 designates an inside mixing blade fixed to the inner shaft 4, comprising inclined plane-like blades and consisting an inside mixing means, reference numeral 7 designates a motor for rotating the outer and inner shaft 3 and 4, reference numeral 8 designates a power transmission gear mechanism for transmitting the rotational driving force of the motor 7 to the outer and inner shaft 3 and 4, reference numeral 9 designates a raw materials feed opening, reference numeral 10 designates a discharge opening formed in the conical-shaped bottom plate 2*a* of the mixing vessel 2, reference numerals 11*a* and 11*b* designate a pair of discharge gates disposed in such a manner as to open and close the discharge opening 10, reference numerals 12*a* and 12*b*designate gaskets disposed on the discharge gates 11*a* and 11*b*, reference numerals 13*a*and 13*b* designate piston rods for horizontally moving the discharge gates 11*a* and 11*b*, respectively, reference numerals 14*a* and 14*b* designate piston rods for vertically moving the discharge gates 11*a* and 11*b*, respectively, and reference numeral 15 designates a connection plate for connecting the ends of the piston rods 14*a* and 14*b* for vertically movement.

The outside mixing blade 5 comprises a mixing blade opposite to the outer periphery of the conical-shaped bottom plate 2*a*, a mixing blade opposite to the inner periphery of the conical-shaped bottom plate 2*a*, and a mixing blade(not shown) opposte the medium conical-shaped bottom plate 2*a*. On the other side, the inside mixing blades 6 are each disposed in such a manner as to extend at a right angle to a mixing blade supporting shaft 6*a* and inclined with a predetermined angle. The mixing blade supporting shaft 6*a* has a mounting flange 6*b* formed at an end (the top end in this figure) thereof and the inner shaft 4 has a mounting flange 4*a* formed at the lower end of the inner shaft 4 so that the mixing blade supporting shaft 6*a* is connected coaxially to the inner shaft 4 by fixing the mounting flange 6*b* to the mounting flange 4*a* with fixtures such as bolts (not shown).

The power transmission gear mechanism 8 is designed to transmit the power of the motor 7 to the respective shafts 3 and 4 in such a manner that the inner shaft 4 rotates faster than the outer shaft 3.

In the pan type mixer 1 as structured above, a pair of the discharge gates 11*a*and 11*b* are moved to the center by the piston rods 13*a* and 13*b* and the discharge gates 11*a* and 11*b* are moved upward by the piston rods 14*a* and 14*b* at the same time so that the discharge gates 11*a* and 11*b* are pushed against the periphery of the discharge opening 10 of the conical-shaped bottom plate 2*a* to close the discharge opening 10. Then, the motor 7 is driven and water, cement, and sand are put into the mixing vessel 2 from the raw material feed opening 9 so as to mix the materials by the outside mixing blade 5, collect them in the center of the mixing vessel 2 by the conical-shaped bottom plate 2*a*, and agitate the materials collected in the center by the inside mixing blades 6 to move them upward and toward the sides of the mixing vessel 2 so that the materials are mixed by the outside mixing blade 5 again. Thus, the raw materials are mixed by the outside and inside mixing blades 5 and 6 while being circulated as mentioned above, thereby making cement mortar. Then, the discharge gates 11*a*, 11*b* are moved downward by the piston rods 14*a*, 14*b* and moved sideways by piston rods 13*a*, 13*b* so as to open the discharge opening 10. Therefore, the resultant cement mortar is discharged through the discharge opening 10 to the forced mixing type of double shaft mixer (not shown) disposed below the pan type mixer 1.

According to the pan type mixer 1 as mentioned above, high quality cement mortar can be made for a short time. Since the inside mixing blade 6 is rotated faster than the outside mixing blade 5 in this case, the materials can be effectively mixed, thereby making high quality cement mortar with high mixing performance.

In such a pan type mixer 1, a predetermined number of mixing blades of the inside mixing blades 6 are mounted on the mixing blade supporting shaft 6*a* in such a manner that these mixing blades are disposed simply at equivalent space in the axial direction. However, the structure that the mixing blades of the inside mixing blades 6 are disposed simply at equivalent space can not securely move upward the materials, which is collected in the center. Therefore, it is difficult to say that the materials can be securely circulated in the mixing vessel 2 and mixed at the highest efficiency.

Moreover, since, in the inside mixing blades 6, a predetermined number of mixing blades are mounted on one mixing blade supporting shaft 6*a*, when one of the mixing blades is damaged, the mixing blade supporting shaft 6*a* and all of the not damaged mixing blades should be replaced as well as the damaged one. This increases the number of parts to be replaced and thus increases the cost. In addition, this makes the replacement quite complex and difficult, thereby complicating the maintenance.

While the pan type mixer 1 disclosed in the aforementioned publication is used as an upper mixer for making cement mortar of the two-stage type mixing machine for mixture, the pan type mixer 1 may be used alone as a mixer for making concrete other than cement mortar. In case of making concrete, the ends of the mixing blades of the inside mixing blades 6 are easily worn due to gravel so as to result in uselessness for a short time. Therefore, to increase the upward flow gravel, each mixing blade of the inside mixing blade 6 should be increased in periphery width in comparison to a case of making mortar. However, it is not sufficient because recently there are various kinds of concrete, for example, ultra high strength concrete, super flowable concrete, light-weight concrete such as forming concrete and fiber reinforced concrete, and it is quite difficult to securely and effectively suite every diversified kind of concrete as mentioned above.

SUMMARY OF THE INVENTION

The present invention is devised under the circumstances as mentioned above and the object is to provide a mixer for mixture which can more effectively mix the materials, allow easy maintenance, and securely and effectively suite every diversified kinds of mixture such as concrete.

In order to achieve this object, the present invention provides a mixer for producing mixture comprising, at least, an inside mixing means disposed at the center of a mixing vessel and connected to an inner shaft so that the inside mixing means is rotated, and an outside mixing means disposed around the periphery of the mixing vessel and connected to an outer shaft so that the outside mixing means is rotated, wherein the mixer mixes materials of mixture, circulating the materials in the mixing vessel, by moving the materials from the bottom of the center toward the upper portion of the center and the periphery of the mixing vessel by the inside mixing means, and moving the materials from the upper periphery toward the lower periphery of the mixing vessel and the center of the mixing vessel by the outside mixing means and conical shaped bottom plate, the mixer is characterized in that the inside mixing means comprises a shaft body connected to the inner shaft and an inside mixing blade detachably fixed to the shaft body for moving the materials, the inside mixing blade comprising a predetermined number of mixing blade elements each having a mixing blade, and the mixing blade elements being detachably fixed to the shaft body.

The present invention is characterized in that each of the mixing blade element has a predetermined number of mixing blades.

The present invention is characterized in that the mixing blade is formed in helical configuration or made of inclined fan-shaped plates.

The present invention is characterized in that the mixing means comprises a plurality of the mixing blade elements, the adjacent mixing blade elements are disposed in such a manner that there is a predetermined space in the axial direction and a predetermined space in the circumferential direction, an overlapped portion in the circumferential direction and a space in the axial direction, or an overlapped portion of a predetermined length and no space between one end of the mixing blade of one of the mixing blade elements and the other end of the mixing blade of the other mixing blade element.

The mixer for producing mixture of the present invention as structured as mentioned above, the inside mixing blade of the inside mixing means comprises a predetermined number of mixing blade elements each having at least one mixing blade. Therefore, when one of the mixing blades is damaged so that the mixer is forced to stop its operation, the inside mixing means can be easily recovered for a short time by replacing the mixing blade element having the damaged mixing blade with new and normal one. Therefore, since there is no need to replace the entire inside mixing means, the cost is significantly reduced and the maintenance of the mixer is thus improved. Furthermore, since the inside mixing means can be easily recovered for a short time, the down time(time of temporarily stop) of the mixer can be shortened so as to significantly improve the operation rate of the mixer.

Particularly, according to the present invention, the inside mixing blade is formed with mixing blades in helical configuration or mixing blades of inclined fan-shaped plates so that the materials are continuously circulated, thereby more effectively mixing the materials and thus producing higher quality mixture.

DESCRIPTION OF THE PREFERRED EMBODIMENTS

Hereinafter, embodiments of the present invention will be described referring to the attached drawings.

Figure 1:
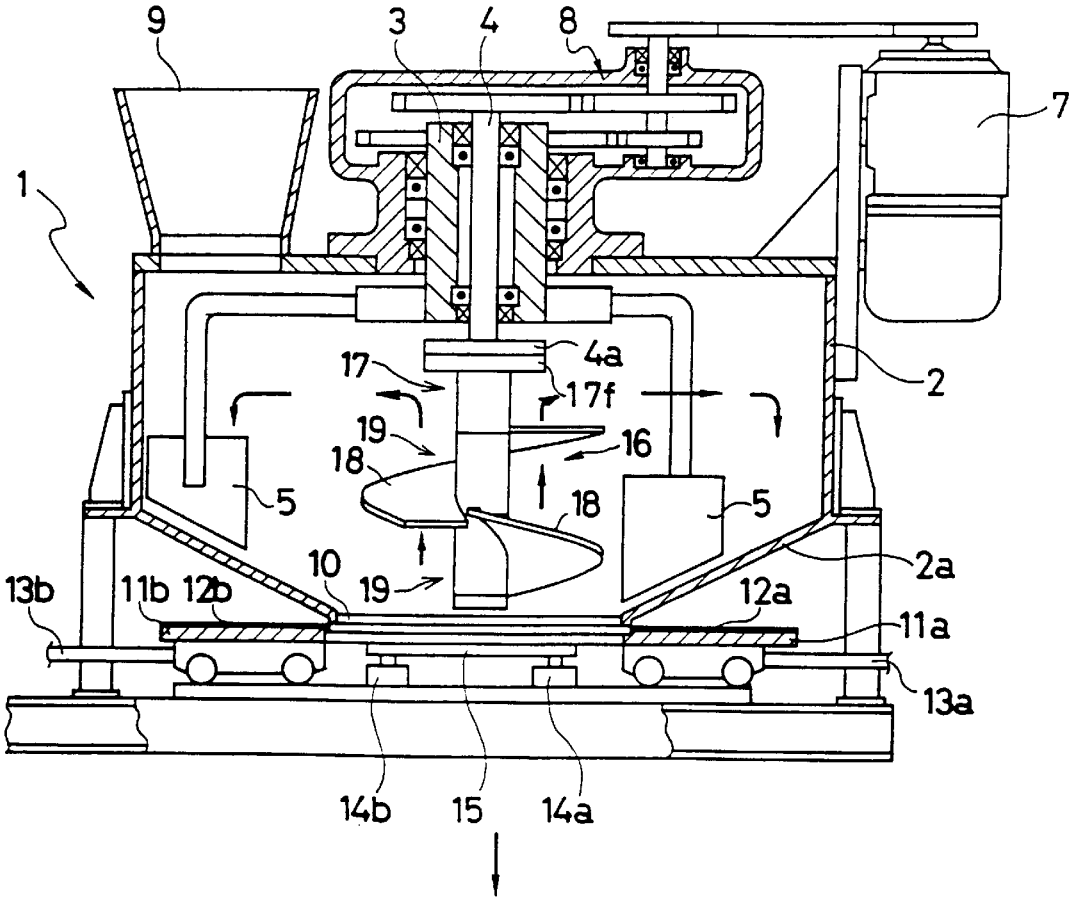
FIG. 1 is a sectional view showing an embodiment of a mixer for mixture according to the present invention.

FIG. 1 is a sectional view showing an embodiment of a mixer for producing mixture according to the present invention in which the present invention is applied to the prior art pan type mixer mentioned above. It should be appreciated that the same components are marked with the same reference numerals as the prior art one mentioned above, respectively, so that the detail description of the same components will be omitted.

In this embodiment, as shown in FIG. 1, an inside mixing means 16 is connected coaxially to the inner shaft 4. The inside mixing means 16 comprises a mixing blade supporting shaft 17 connected coaxially to the inner shaft 4 and two mixing blade elements 19, 19 mounted on the mixing blade supporting shaft 17, the mixing blade elements 19, 19 constituting together an inside mixing blade 18 formed in helical configuration.

Figure 2A:
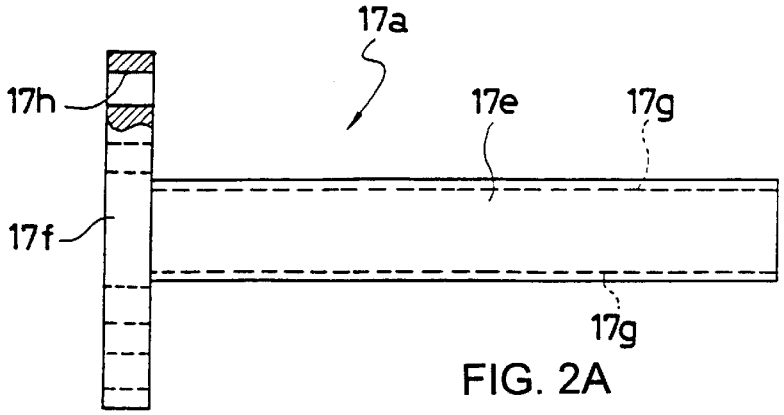
FIG. 2A is a front view of a shaft for an inside mixing means.
Figure 2B:
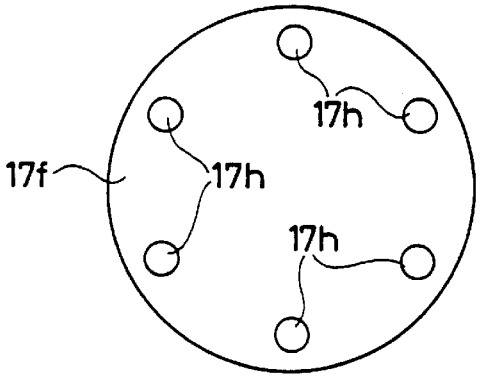
FIG. 2B is a left-side view of the shaft for the inside mixing means.
Figure 2C:
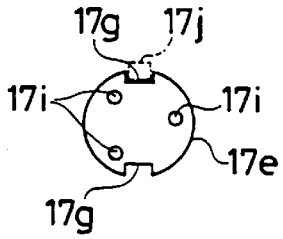
FIG. 2C is a right-side view of the shaft for the inside mixing means.
Figure 3A:
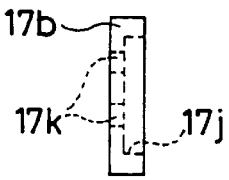
FIG. 3A is a front view of an end plate member.
Figure 3B:
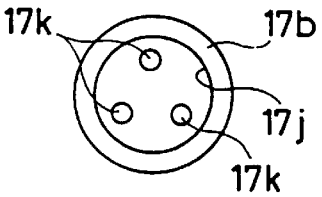
FIG. 3B is a right side view of the end plate member.
Figure 4A:
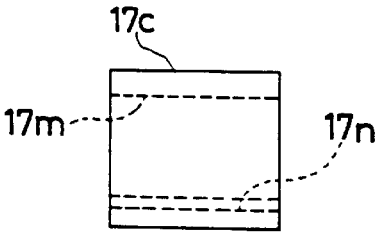
FIG. 4A is a front view of a spacer.
Figure 4B:
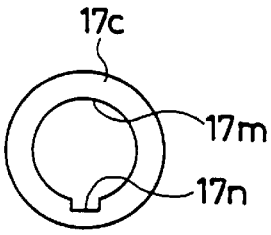
FIG. 4B is a right-side view of the spacer.

The mixing blade supporting shaft 17 comprises a shaft body 17*a* shown in FIGS. 2(*a*) through 2(*c*), a disk-like end plate 17*b* shown in FIGS. 3(*a*) and 3(*b*), and a cylindrical spacer 17*c* shown in FIGS. 4(*a*) and 4(*b*).

As shown in FIGS. 2(*a*) through 2(*c*), the shaft body 17*a* comprises a rotational shaft portion 17*e*, a mounting flange 17*f* disposed on one end of the rotational shaft portion 17*e* and connected to the mounting flange 4*a* of the inner shaft 4, and two key ways 17*g*, 17*g* formed in the outer periphery of the rotational shaft portion 17*e* in such a manner as to extend in the axial direction. The mounting flange 17*f* is provided with a predetermined number (six in this figure) of mounting holes 17*h* into which bolts are inserted respectively to connect the mounting flange 17*f* with the mounting flange 4*a* of the inner shaft 4. The other end of the rotational shaft portion 17*e* is provided with a predetermined number (three in this figure) of female screw boxes 17*i* into which bolts (not shown) for mounting the end plate 17*b* are screwed respectively. The two key ways 17*g* and 17*g* are shifted 180 from each other in such a manner that the key ways 17*g*, 17*g* are formed opposite to each other. Each key way 17*g*, 17*g* allows a key 17*q* to be fitted therein.

As shown in FIGS. 3(*a*) and 3(*b*), the end plate 17*b* is provided with a circular recess 17*j* at one side thereof. The recess 17*j* is provided with a predetermined number (three in this figure) of bolt through holes 17*k* which are formed in the bottom thereof to correspond to the female screw boxes 17*i* and through which the bolts for mounting the end plate 17*b* are tightened.

As shown in FIGS. 4(*a*) and 4(*b*), the spacer 17*c* is provided with a through hole 17*m* axially extending in such a manner as to allow the rotational shaft portion 17*e* to be inserted therethrough, and a key way 17*n* axially extending in such a manner as to allow the aforementioned key 17*q* to be inserted therein.

Figure 5A:
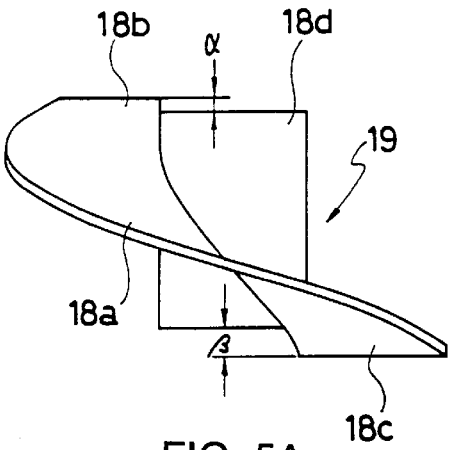
FIG. 5A is a front elevational view of an embodiment mixing blade element.
Figure 5B:
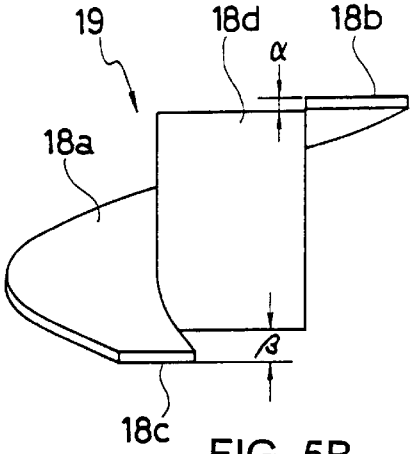
FIG. 5B is an elevational view of the mixing blade element illustrated in FIG. 5A rotated 120°.
Figure 5C:
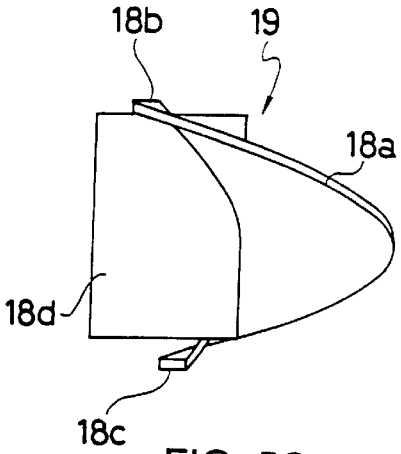
FIG. 5C is an elevational view of the mixing blade element illustrated in FIG. 5A rotated 240°.
Figure 6:
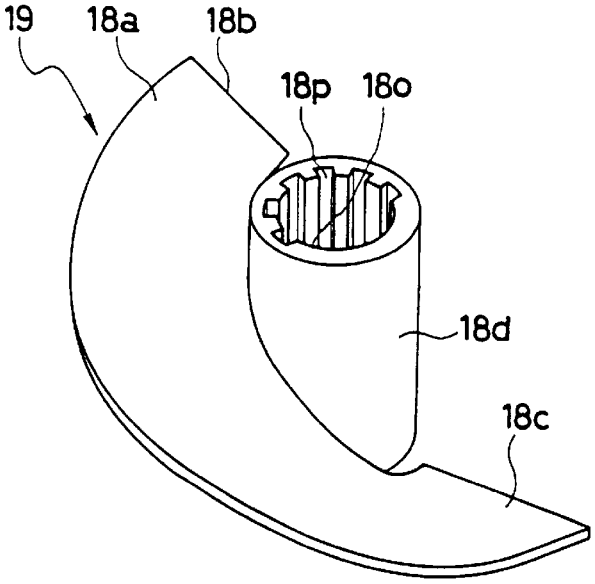
FIG. 6 is a oblique view of the mixing blade element of the embodiment.

As shown in FIGS. 5(*a*) through 5(*c*), the first and second mixing blade elements 19 and 19 each have a blade supporting member 18*d* and a mixing blade 18*a*formed on the supporting member 18*d*. The blade supporting member 18*d* has a through hole 18*o* axially extending in such a manner as to allow the rotational shaft portion 17*e* of the shaft body 17*a* to be inserted therethrough and a predetermined number of key ways 18*p* axially extending and formed in the inner periphery of the blade supporting member 18*d* in such a manner as to allow the key 17*q* to be inserted.

The mixing blade 18*a* is formed in helical configuration and has greater periphery width to improved carring upward travel as one of concrete materials. The helical mixing blade 18*a* has an upper end 18*b* projecting upward in the axial direction from the upper end of the supporting member 18*d* by a predetermined amount α(substantially equal to the thickness of the mixing blade 18*a*), and a lower end 18*c*projecting downward in the axial direction from the lower end of the supporting member 18*d* by a predetermined amount β (equal or not equal to the projecting amount a of the upper end 18*b*). The mixing blade 18*a* is formed in such a manner that the lower end 18*c* is positioned circumferentially shifted nearly 180 from the upper end 18*b*.As shown FIGS. 5(*a*) through 5(*c*), the supporting member 18*d* and the mixing blade 18*a*constitute each mixing blade element 19.

For assembling the mixing blade elements 19 to the shaft body 17*a*, the spacer 17*c* is inserted to the rotational shaft portion 17*e* of the shaft body 17*a* until the upper end of the spacer 17*c* comes into contact with the bottom face of the mounting flange 17*f*, and the key way 17*n* of the spacer 17*c* is opposed to one of the key ways 17*g* of the shaft body 17*a*. Then the key 17*q* is inserted into the key ways 17*n* and 17*g* so that the spacer 17*c* is temporarily stopped from rotating relative to the shaft body 17*a* and from easily moving in the axial direction.

Then, the first mixing blade element 19, one of two mixing blade elements 19 and 19, is inserted to the rotational shaft portion 17*e* until the upper end of the supporting member 18*d* thereof comes into contact with the lower end of the spacer 17*c*. In this case, in the same manner as the spacer 17*c*, one of the key ways 18*p* of the first mixing blade element 19 is opposed to the key way 17*g* of the rotational shaft portion 17*e* and the key 17*q* is inserted into the key ways 18*p* and 17*g* so that the first mixing blade element 19 is stopped from rotating relative to the shaft body 17*a* and from easily moving in the axial direction.

Figure 7B:
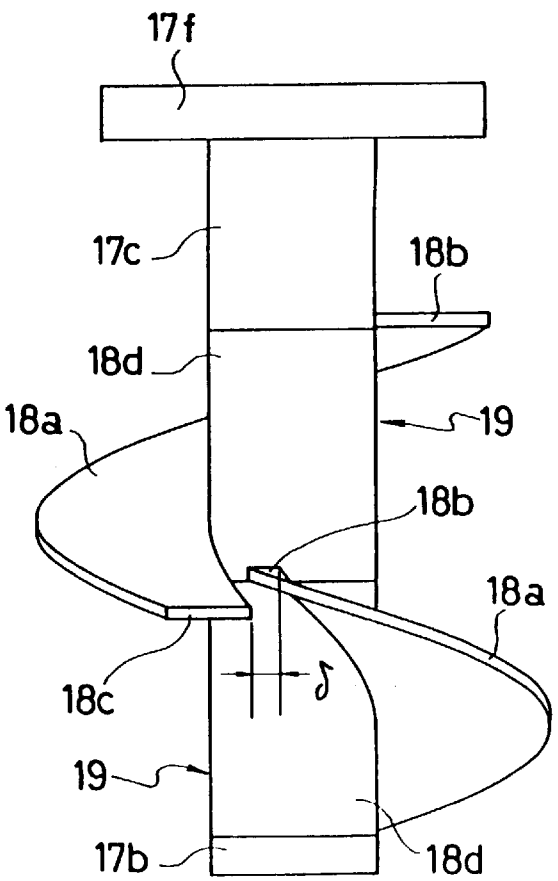
FIG. 7B is a right-side view of the embodiment inside mixing means.
Figure 7A:
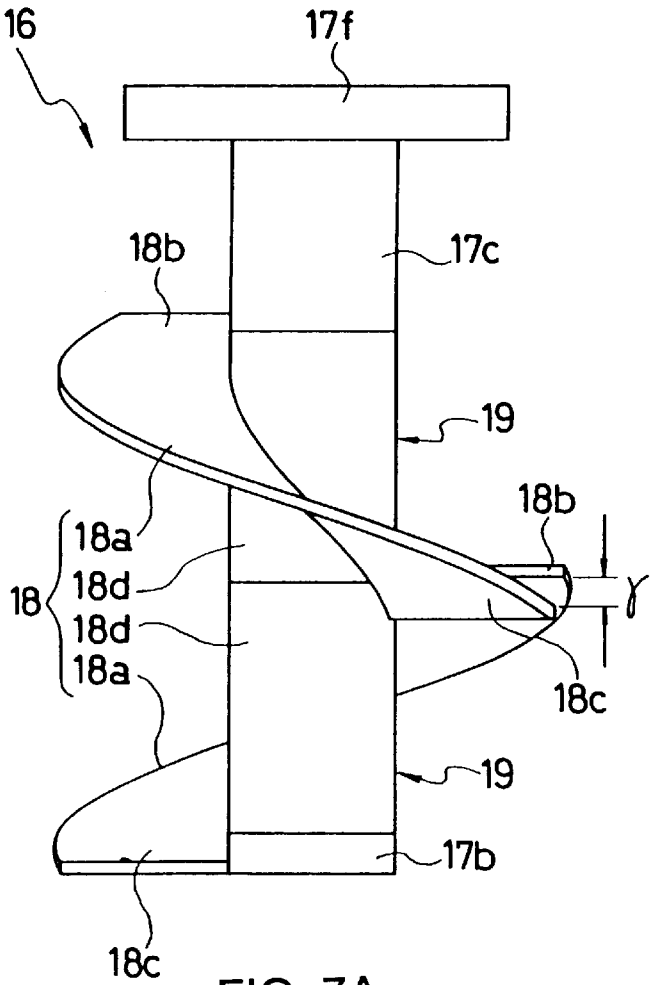
FIG. 7A is a front view of an embodiment inside mixing means.

Subsequently, the other mixing blade element 19 is inserted to the rotational shaft portion 17*e* until the upper end of the supporting member 18*d* thereof comes into contact with the lower end of the supporting member 18*d* of the first mixing blade element 19. In this case, one of the key ways 18*p* of the second mixing blade element 19 is opposed to the key way 17*g* of the rotational shaft portion 17*e* in such a manner that the upper end 18*b* of the mixing blade 18*a* of the second mixing blade element 19 is positioned to have a space δ from the lower end 18*c* of the mixing blade 18*a* of the first mixing blade element 19. In this manner, the key 17*q* is inserted into the key ways 18*p* and 17*g* so that the second mixing blade element 19 is temporarily stopped from rotating relative to the shaft body 17*a* and from easily moving in the axial direction. The aforementioned space δ in the circumferential direction is set by suitably selecting the key ways 18*p*, 17*g*. At this point, the upper end 18*b* of the mixing blade 18*a* of the second mixing blade element 19 is positioned to have a predetermined spaceγ in the axial direction from the lower end 18*c* of the mixing blade 18*a* of the first mixing blade element 19 as shown in FIG. 7(*a*).

Finally, the end plate 17*b* is fitted to the other end of the rotational shaft portion 17*e* and the bolts (not shown) are screwed into the female screw boxes 17*i*through the bolt through holes 17*k* so as to fix the end plate 17*b* to the end of the rotational shaft portion 17*e*. In this manner, the two mixing blade elements 19, 19 are assembled to the shaft body 17*a* as shown in FIGS. 7(*a*) and 7(*b*).

When the two mixing blade elements 19, 19 are assembled to the shaft body 17*a*, the mixing blade elements 19, 19 are prevented from coming off the rotational shaft portion 17*e* of the shaft body 17*a* in the axial direction by the end plate 17*b*. The mixing blade element 19, 19 are prevented from rotating relative to the shaft body 17*a* by the key 17*q*. On the whole, the mixing blades 18*a*, 18*a* of the mixing blade elements 19, 19 make the inside mixing blade 18 in a fragmentary helical shape of substantially 360°.

The shaft body 17*a* with the mixing blade elements 19, 19 is connected to the inner shaft 4 by fitting the mounting flange 17*f* to the mounting flange 4*a* of the inner shaft 4, inserting the bolts (not shown) into the mounting holes 17*h* of the mounting flange 17*f* and the mounting holes (not shown) of the mounting flange 4*a*, and screwing nuts to the bolts to fasten the mounting flanges 17*f* and 4*a*. It should be noted that the shaft body 17*a* may be connected to the inner shaft 4 before assembling the spacer 17*c*, the mixing blade elements 19, 19, and end plate 17*b* to the shaft body 17*a*.

In the mixer 1 of this embodiment as structured above, as the motor 7 rotates the inner shaft 4, the rotation of the inner shaft 4 causes the inside mixing means 16 to rotate. Thus, the helical inside mixing blade 18 of the inside mixing means 16 continuously agitates concrete materials, i.e. sand, gravel, water, and cement etc., in the center of the mixing vessel 2, and carries them upward. Then the concrete materials move toward the sides of the mixing vessel 2. The reason why the continuous propulsion force moving upward is exerted on the concrete materials is that the inside mixing blade 18 is formed in the helical configuration.

After moving toward the sides of the mixing vessel 2, the concrete materials are agitated by the outside mixing blade 5 so that the concrete materials move to the center of the conical-shaped bottom plate 2*a*. After moving to the center of the conical-shaped bottom plate 2*a*, the concrete materials are agitated and carried upward again by the helical inside mixing blade 18. In this manner, the concrete materials can be effectively mixed by repeating the agitation and conveyance by the inside and outside mixing blades 18 and 5, thereby producing high quality concrete with high mixing performance.

There is a possibility that the inside mixing means 16 becomes worn-out since, for example, one of the mixing blades 18*a*, 18*a* of the mixing blade elements 19, 19 is damaged during using the mixer 1. In this case, only the mixing blade element 19 having the damaged mixing blade 18*a* is replaced with new one with normal mixing blade 18*a* in the mixer 1 of this embodiment, while the entire inside mixing means should be replaced with new and normal one in the conventional mixer as mentioned above. Following are discussions on the replacement of the mixing blade element 19. The replacement may be made by first removing the end plate 17*b* from the rotational shaft portion 17*e*, pulling out the mixing blade elements 19 from the rotational shaft portion 17*e*, and then assembling a new and normal mixing blade element 19 for the mixing blade element 19 having the damaged mixing blade 18*a* and the used and normal another mixing blade element 19 to the rotational shaft portion 17*e* as mentioned above.

Figure 14:
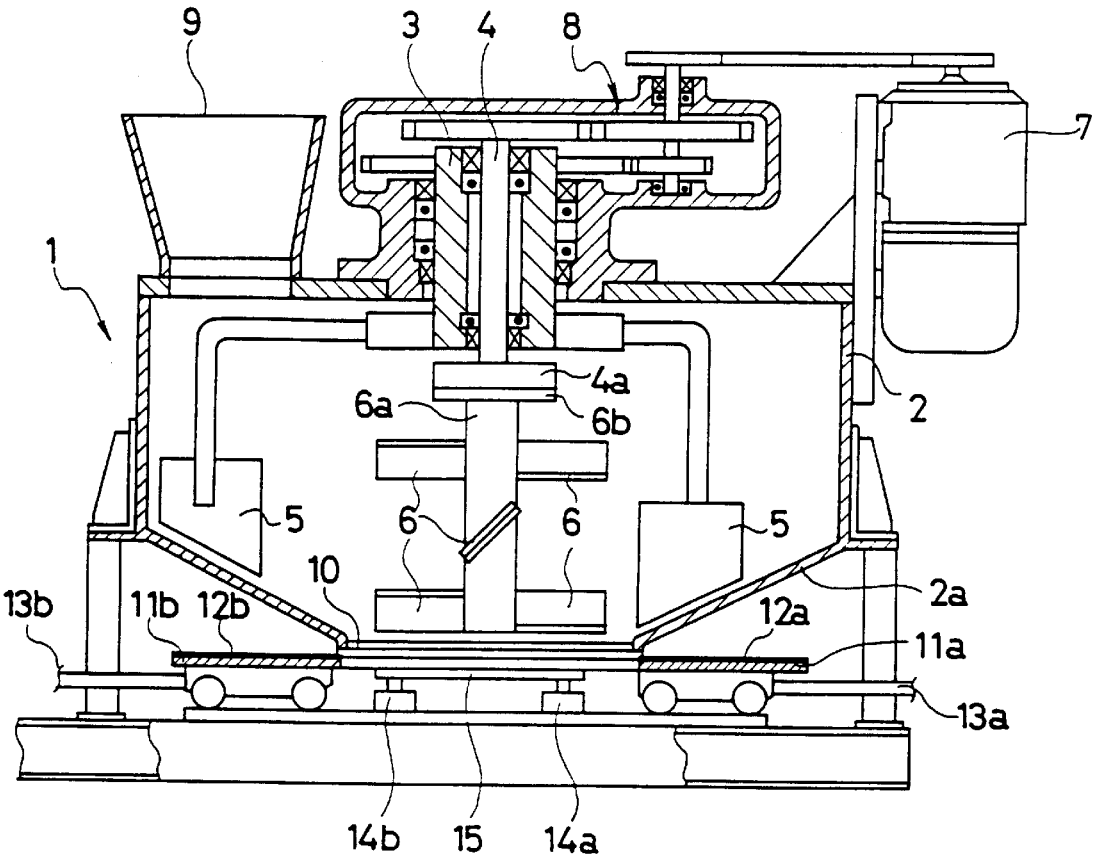
FIG. 14 PRIOR ART
FIG. 14 is a sectional view showing one example of a prior art mixer.

According to the mixer 1 of this embodiment, the inside mixing blade 18 of the inside mixing means 16 is formed in the helical configuration so that the concrete materials are continuously circulated. Therefore, the mixer 1 of this embodiment can mix the concrete materials more effectively than the conventional mixer 1 as shown in FIG. 14, thereby producing high quality concrete.

Since the inside mixing blade 18 of the inside mixing means 16 comprises two mixing blades 18*a* and 18*a*, when one of the mixing blades 18*a* is damaged so that the inside mixing means 16 becomes worn-out, only the mixing blade element 19 having the damaged mixing blade 18*a* is replaced, thereby easily recovering the inside mixing means 16 in a short time. Since there is no need to replace the entire inside mixing means 16, the cost is significantly reduced and the maintenance of the mixer 1 is improved. Furthermore, since the inside mixing means 16 can be easily recovered in a short time, the down time of the mixer 1 can be shorten so as to significantly improve the rate of operation of the mixer 1.

Figure 8B:
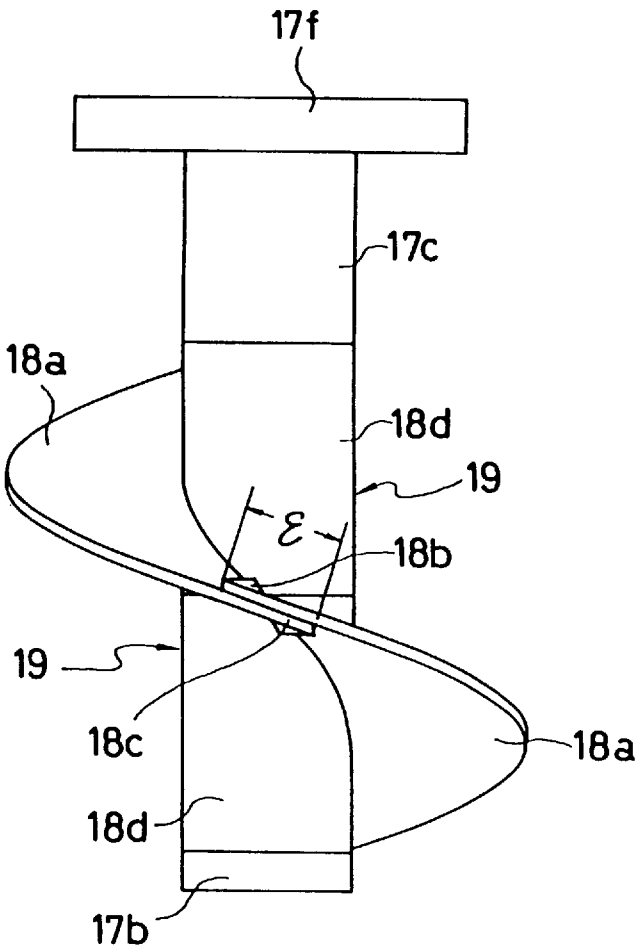
FIGS. 8A and 8B are views similar to FIGS. 7A and 7B showing another embodiment of the inside mixing means.
Figure 8A:
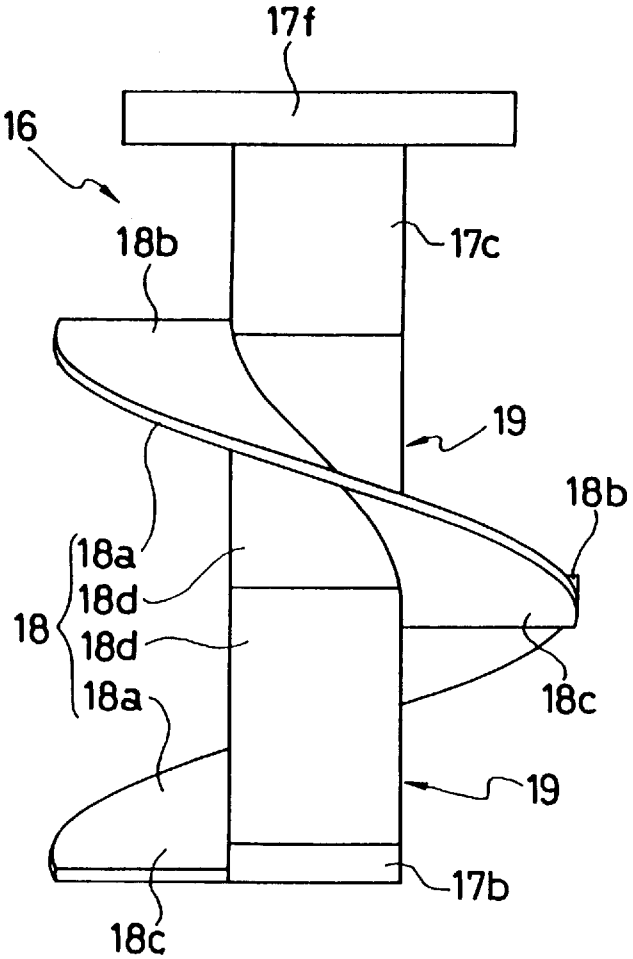
Figure 9A:
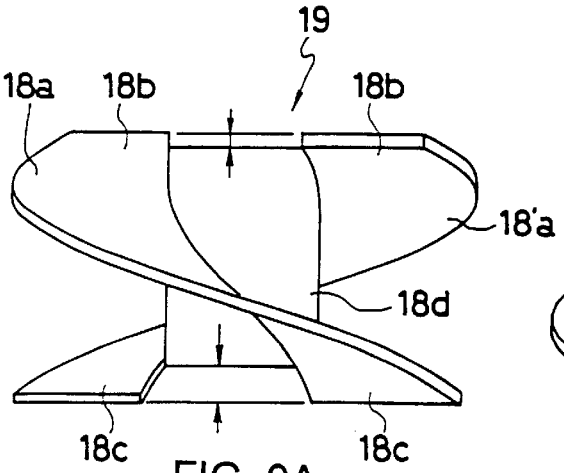
FIGS. 9A–9D shows still another embodiment of the mixing blade element taken from sides shifted 90°, respectively.
Figure 9B:
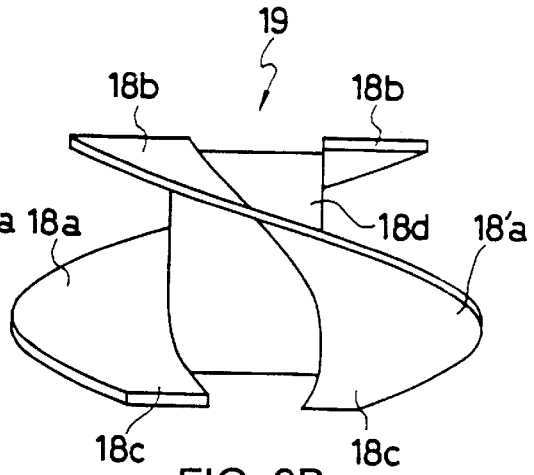
Figure 9C:
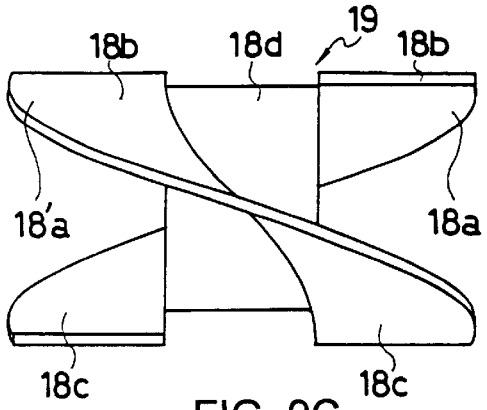
Figure 9D:
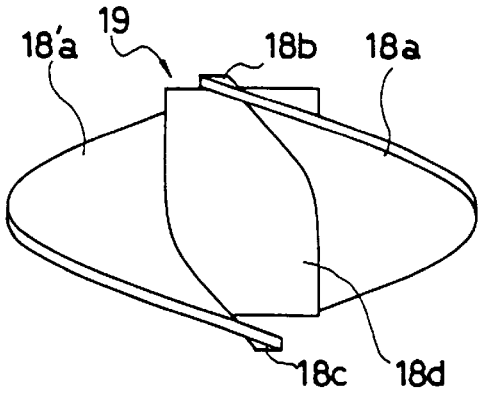

FIG. 8 is a view similar to FIG. 7, showing another embodiment of the present invention. It should be appreciated that the same components are marked with the same reference numerals as the embodiment mentioned above, respectively, so that the detail description of the same components will be omitted.

In the aforementioned embodiment shown in FIG. 7, the configuration and size of each mixing blade 18*a* are set in such a manner as to have an axial space γ and circumferential space 6 between the lower end 18*c* of the mixing blade 18*a* of the first mixing blade element 19 and the upper end 18*b* of the mixing blade 18*a* of the second mixing blade element 19 so that the lower end 18*c* and the upper end 18*b* are spaced each other by the key way 18*p* inner diameter of blade supporting 18*d*. On the other hand, in this embodiment shown in FIG. 8, the configuration and size of each mixing blade 18*a* are set in such a manner as to have an overlapped portion of a predetermined length E between the lower end 18*c* of the mixing blade 18*a* of the first mixing blade element 19 and the upper end 18*b* of the mixing blade 18*a* of the second mixing blade element 19 so that the lower end 18*c* and the upper end 18*b* are closely connected to each other. Therefore, the mixing blade 18*a* of the first mixing blade element 19 and the mixing blade 18*a* of the second mixing blade elements 19 make an inside mixing blade 18 in a continuous helical shape of substantially 360°. The other components of this embodiment are the same as those of the aforementioned embodiment shown in FIG. 1 through FIG. 7, and FIG. 14.

In the mixer 1 of this embodiment as structured above, the inside mixing blade 18 is continuously formed with the result that concrete materials can be mixed and carried upward by the inside mixing blade 18 more effectively than the aforementioned embodiment. The other operation and effects of this embodiment are the same as the operation and effects of the aforementioned embodiment shown in FIG. 1 through FIG. 7.

Though the lower end 18*c* of the mixing blade 18*a* of the first mixing blade element 19 and the upper end 18*b* of the mixing blade 18*a* of the second mixing blade element 19 are disposed to have the overlapped portion of a predetermined length ϵtherebetween and closely connected to each other in this embodiment, the present invention is not limited thereto and the lower end 18*c* of the mixing blade 18*a* of the first mixing blade element 19 and the upper end 18*b* of the mixing blade 18*a* of the second mixing blade element 19 may be disposed to have an overlapped portion having a predetermined length e and an axial space r therebetween.

Figure 10:
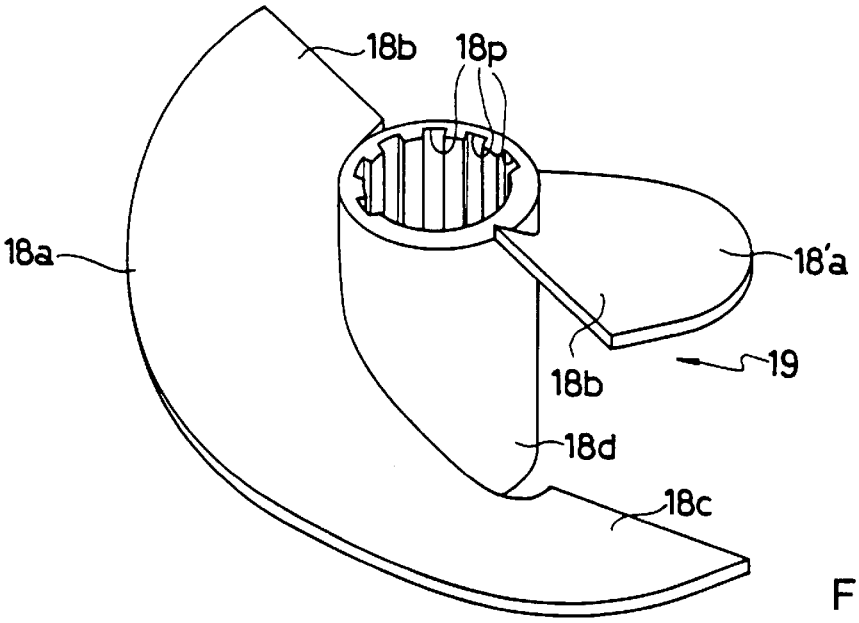
FIG. 10 is a perspective view of the mixing blade element of the embodiment shown in FIG. 9.
Figure 11B:
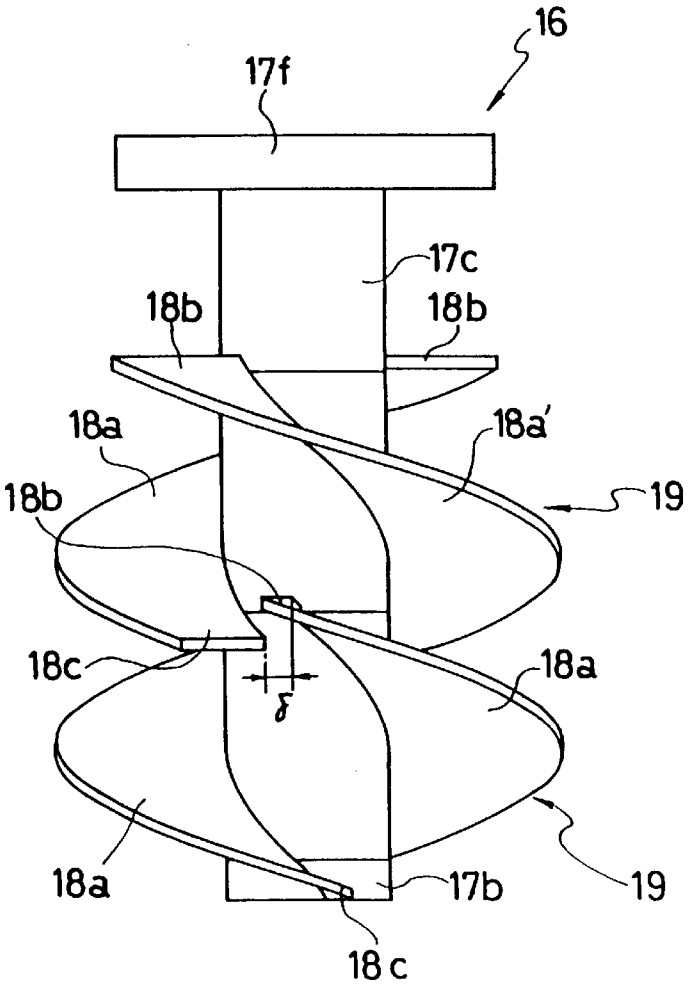
FIG. 11B is a right-side view of the inside mixing means of the embodiment shown in FIG. 9A through 9D.
Figure 11A:
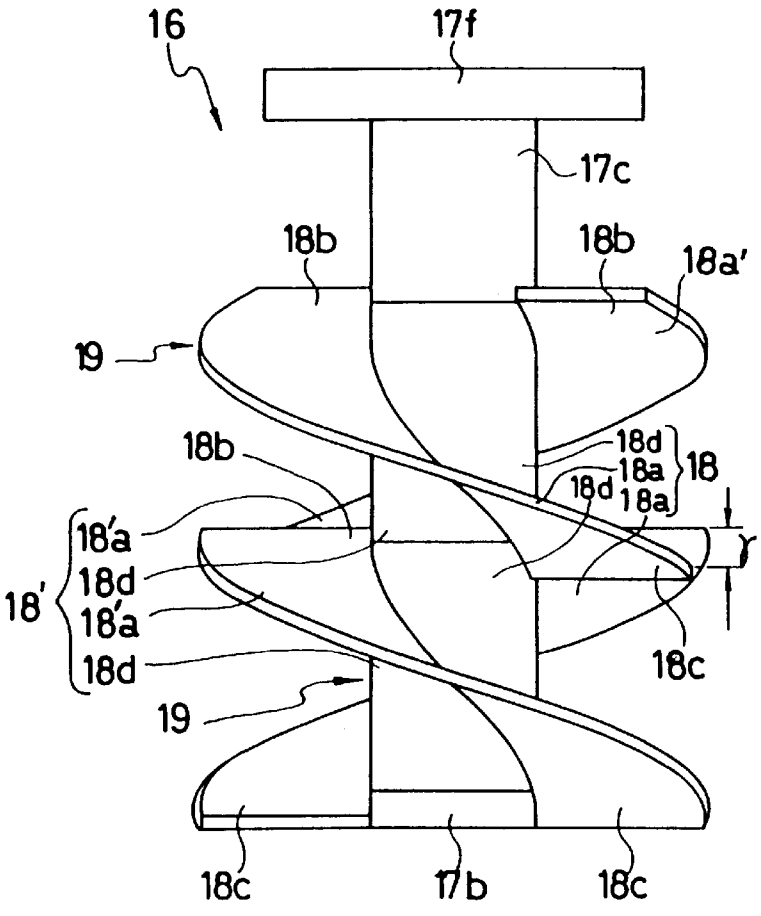
FIG. 11A is a front view of the inside mixing means of the embodiment shown in FIG. 9A through 9D.

FIG. 9 through FIG. 11 are views similar to FIG. 7, showing still another embodiment of the present invention. It should be appreciated that the same components are marked with the same reference numerals as the embodiment mentioned above, respectively, so that the detail description of the same components will be omitted.

Though each mixing blade element 19 has only one helical mixing blade 18a in the aforementioned embodiments, each mixing blade element 19 has two helical mixing blades 18*a*, 18*a*' in this embodiment as shown in FIGS. 9 through FIG. 11. In this embodiment, the configurations and sizes of the mixing blades 18*a*, 18*a*' are set in such a manner as to have axial spaces r and circumferential spaces δ (similarly to the embodiment shown in FIG. 7) between the lower end 18*c* of the mixing blade 18*a* of the first mixing blade element 19 and the upper end 18*b* of the mixing blade 18*a* of the second mixing blade element 19 and between the lower end 18*c* of the mixing blade 18*a*'of the first mixing blade element 19 and the upper end 18*b* of the mixing blade 18*a*' of the second mixing blade element 19, respectively (It should be understood that the spaces γ and δ between the lower end 18*c* of the mixing blade 18*a*' and the upper end 18*b* of the mixing blade 18*a*' are not shown in FIG. 11 but actually exist). Therefore, the mixing blades 18*a*, 18*a*' of the mixing blade elements 19, 19 make two inside mixing blades 18, 18' each formed in a fragmentary helical shape of substantially 360°. The other components of this embodiment are the same as those of the embodiments shown in FIG. 1 through 7 and FIG. 14.

In the mixer 1 of this embodiment as structured above, the two inside mixing blades 18, 18' are formed with the result that concrete materials can be mixed and carried upward by the inside mixing blades 18, 18' more effectively than the aforementioned embodiment shown in FIG. 7. The other operation and effects of this embodiment are the same as the operation and effects of the aforementioned embodiment shown in FIG. 1 through FIG. 7.

Figure 12B:
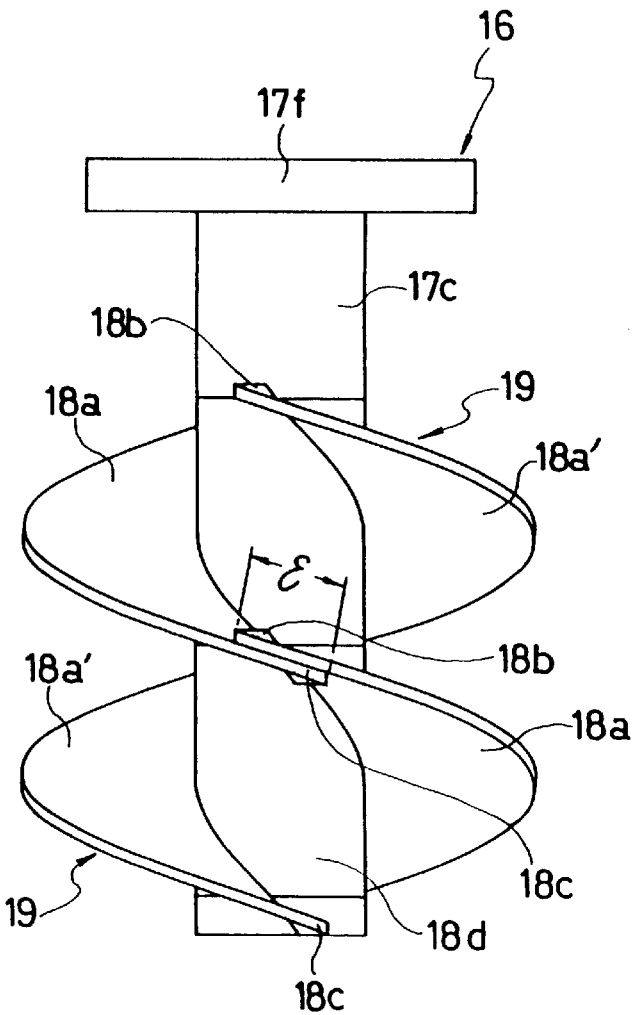
FIGS. 12A and 12B are views similar to FIG. 7A and 7B showing yet another embodiment of the inside mixing means.
Figure 12A:
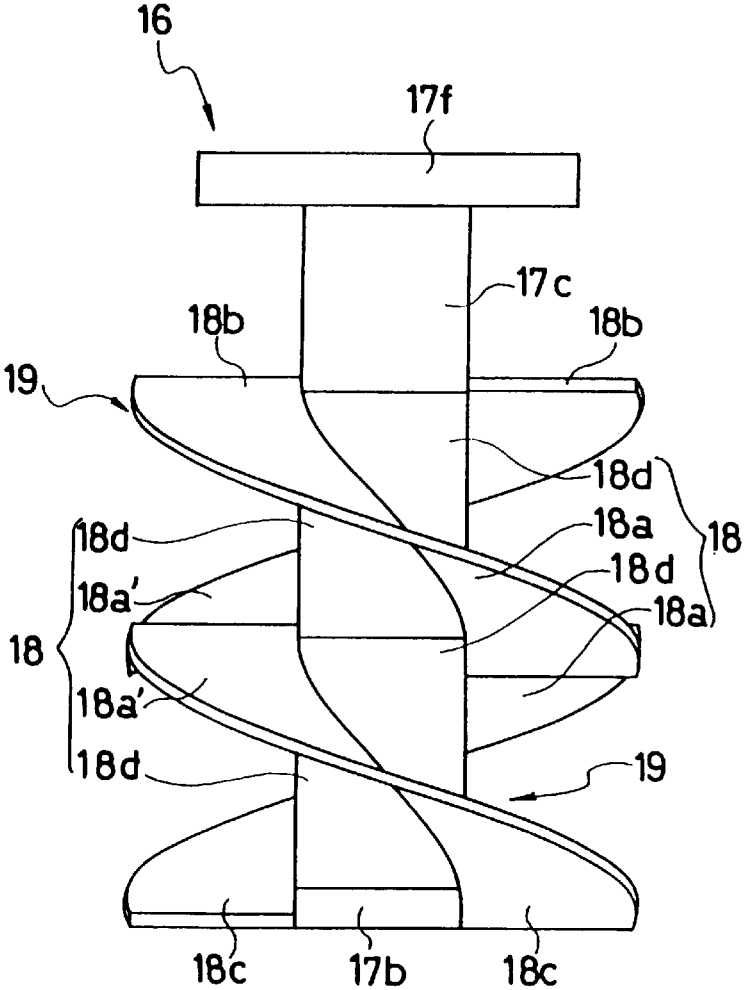

FIG. 12 is a view similar to FIG. 8, showing yet another embodiment of the present invention. It should be appreciated that the same components are marked with the same reference numerals as the embodiment mentioned above, respectively, so that the detail description of the same components will be omitted.

In the aforementioned embodiment shown in FIG. 11, the configuration and size of each mixing blade 18*a*, 18*a*' are set in such a manner as to have axial spaces γand circumferential spaces δ between the lower end 18*c* of the mixing blade 18*a* of the first mixing blade element 19 and the upper end 18*b* of the mixing blade 18*a* of the second mixing blade element 19 and between the lower end 18*c* of the mixing blade 18*a*'of the first mixing blade element 19 and the upper end 18*b* of the mixing blade 18*a*' of the second mixing blade element 19, respectively, so that the lower ends 18*c* of the mixing blades 18*a*, 18*a*' are spaced from the upper ends 18*b* of the mixing blades 18*a*, 18*a*', respectively. On the other hand, in this embodiment shown in FIG. 12, the configuration and size of each mixing blade 18*a*, 18*a*' are set in such a manner as to have overlapped portions each having a predetermined length ϵ between the lower end 18*c* of the mixing blade 18*a* of the first mixing blade element 19 and the upper end 18*b* of the mixing blade 18*a* of the second mixing blade element 19 and between the lower end 18*c* of the mixing blade 18*a*' of the first mixing blade element 19 and the upper end 18*b* of the mixing blade 18*a*' of the second mixing blade element 19, respectively, so that the lower ends 18*c* are closely connected to the upper ends 18*b*, respectively. Therefore, the mixing blade 18*a* of the first mixing blade element 19 and the mixing blade 18*a* of the second mixing blade element 19, and the mixing blade 18*a*'of the first mixing blade element 19 and the mixing blade 18*a*' of the second mixing blade element 19 make two inside mixing blades 18, 18' each formed in a continuous helical shape of substantially 360°. The other components of this embodiment are the same as those of the aforementioned embodiment shown in FIG. 1 through FIG. 7, and FIG. 14.

In the mixer 1 of this embodiment as structured above, the two inside mixing blades 18, 18' are continuously formed with the result that concrete materials can be mixed and carried upward by the inside mixing blades 18, 18' more effectively than any one of the aforementioned embodiments. The other operation and effects of this embodiment are the same as the operation and effects of the aforementioned embodiment shown in FIG. 9 through FIG. 11.

Though the lower ends 18*c* of the mixing blades 18*a*, 18*a*' of the first mixing blade element 19 and the upper ends 18*b* of the mixing blades 18*a*, 18*a*' of the second mixing blade element 19 are disposed to have the overlapped portions each having a predetermined length ϵ therebetween and closely connected to each other in this embodiment, the present invention is not limited thereto and the lower ends 18*c* of the mixing blades 18*a*, 18*a*' of the first mixing blade element 19 and the upper ends 18*b* of the mixing blades 18*a*, 18*a*' of the second mixing blade element 19 may be disposed to have overlapped portions each having a predetermined length ϵ and an axial space γtherebetween.

Figure 13B:
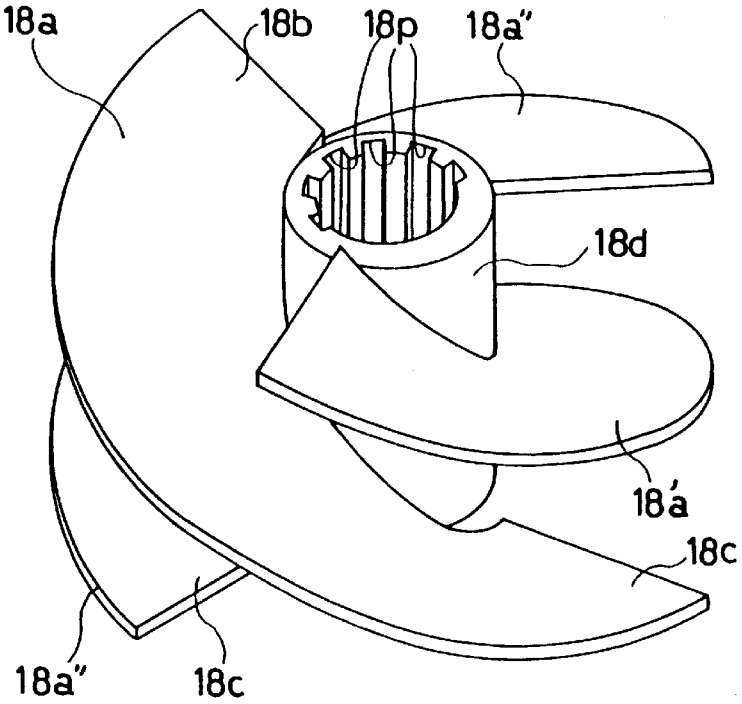
FIG. 13B is a perspective view of the mixing blade element of the inside mixing means shown in FIG. 13A.
Figure 13A:
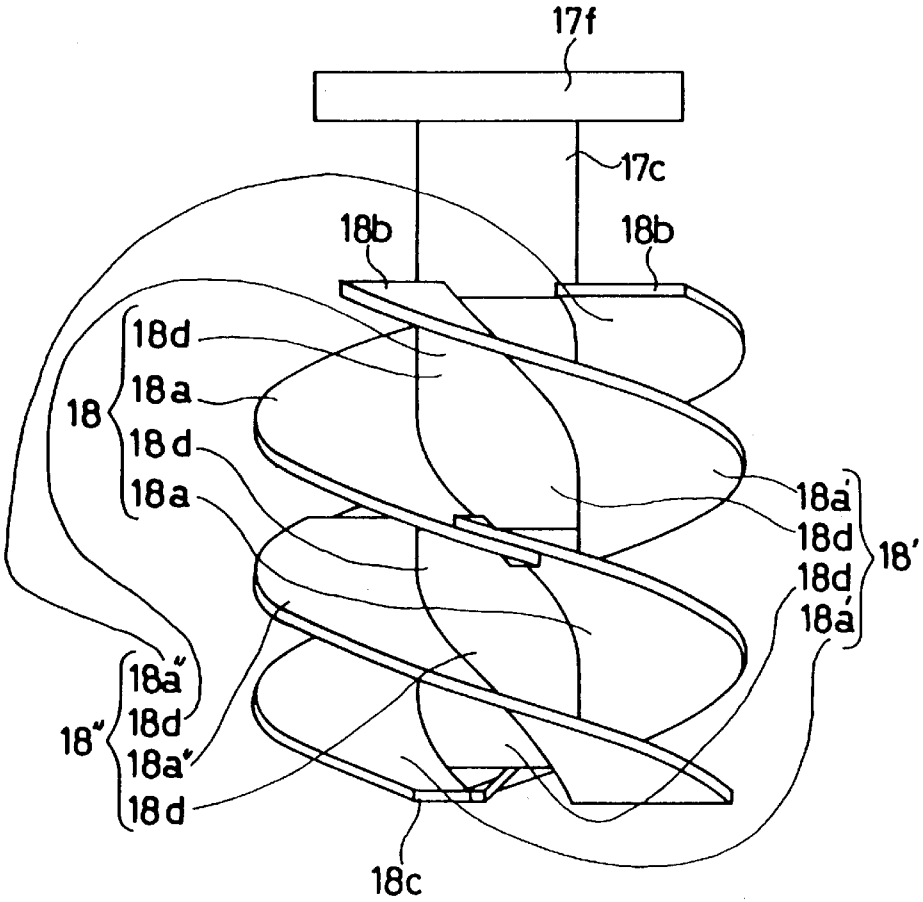
FIG. 13A is a front view of still a further embodiment of the inside mixing means.

FIG. 13 is a view similar to FIG. 12, showing further still another embodiment of the present invention. It should be appreciated that the same components are marked with the same reference numerals as the embodiment mentioned above, respectively, so that the detail description of the same components will be omitted.

While the mixing blade element 19 has two helical mixing blades 18*a*, 18*a*' in the aforementioned embodiment shown in FIG. 12, the mixing blade element 19 has three helical mixing blades 18*a*, 18*a*', 18*a*" in this embodiment as shown in FIG. 13. The configuration and size of each mixing blade 18*a*, 18*a*', 18*a*" are set in such a manner as to have overlapped portions each having a predetermined length e between the lower end 18*c* of the mixing blade 18*a* of the first mixing blade element 19 and the upper end 18*b* of the mixing blade 18*a* of the second mixing blade element 19, between the lower end 18*c* of the mixing blade 18*a*' of the first mixing blade element 19 and the upper end 18*b* of the mixing blade 18*a*' of the second mixing blade element 19, and between the lower end 18*c* of the mixing blade 18*a*' of the first mixing blade element 19 and the upper end 18*b* of the mixing blade 18*a*" of the second mixing blade element 19, respectively, so that the lower ends 18*c* are closely connected to the upper ends 18*b*, respectively.

The other components and operation and effects of this embodiment are the same as those of the aforementioned embodiment shown in FIG. 12. Though the lower ends 18*c* of the mixing blades 18*a*, 18*a*', 18*a*" of the first mixing blade element 19 and the upper ends 18*b* of the mixing blades 18*a*, 18*a*', 18*a*" of the second mixing blade element 19 are disposed to have the overlapped portions each having a predetermined length ϵ therebetween and closely connected to each other in this embodiment, the lower ends 18*c* of the mixing blades 18*a*, 18*a*', 18*a*" of the first mixing blade element 19 and the upper ends 18*b* of the mixing blades 18*a*, 18*a*', 18*a*" of the second mixing blade element 19 may be disposed to have axial spaces γ and circumferential spaces δtherebetween or to have overlapped portions each having a predetermined length ϵand an axial space γ therebetween.

It should be understood that the mixing blade 18*a* of the inside mixing means 16 may be made by an inclined fan-shaped plate or may be other configuration than the helical shape, i.e. the same as the prior art shown in FIG. 14.

Though the two mixing blade elements 19 are provided in the respective embodiments mentioned above, one or three or more mixing blade elements 19 may be provided and may have four or more blades 18*a*. Moreover, the mixing blade 18a may be formed in a configuration twisted by 360° than nearly 180°. In this case, mixing blade elements 19 having different numbers of mixing blades 18*a* may be combined or mixing blade elements 19 having mixing blades 18*a* of different configurations may be also combined. Furthermore, the inside mixing means 16 having a predetermined number of mixing blade elements 18 may have any construction other than the construction comprising the shaft body 17*a*, the end plate 17*b*, the spacer 17*c*, and the like as mentioned above.

By using a single mixer 1 among the aforementioned embodiments or suitably combining the mixing blade elements 19 having different numbers of mixing blades, the mixer can be positively and effectively adopted for producing every diversified kinds of concrete as mentioned above.

Though the present invention was discussed for the mixer for producing concrete in the respective embodiments, the present invention is not limited thereto and may be adopted to mix other construction materials such as mortar than the concrete materials, industrial wastes, chemical substances, mud, or the like.

As apparent from the above description, according to the mixer of the present invention, the inside mixing means comprises two or more mixing blade elements each having a predetermined number of mixing blades so that when a mixing blade is damaged, the inside mixing means can be easily recovered for a short time by replacing the mixing blade element having the damaged mixing blade with new and normal one. Therefore, since there is no need to replace the entire inside mixing means, the cost is significantly reduced and the maintenance of the mixer is improved. Furthermore, since the inside mixing means can be easily recovered for a short time, the outage time of the mixer can be shorten so as to significantly improve the rate of operation of the mixer.

Particularly, according to the present invention, the inside mixing blade is formed with mixing blades in helical configuration or mixing blades of inclined fan-shaped plates so that the materials are continuously circulated and are recieved great shearing force, thereby more effectively mixing the materials and thus producing higher quality mixture. More particularly, the invention as claimed allows various types of mixers to be made so as to positively and effectively suite every diversified kinds of concrete, for example, ultra high strength concrete, super flowable concrete, light-weight concrete such as forming concrete and fiber reinforced concrete, and it is quite difficult to securely and effectively suite every diversified kinds of concrete as mentioned above.

What we claim is:

1. A mixer for producing mixture comprising:

an inside mixing means disposed at a center of a mixing vessel and connected to an inner shaft so that the inside mixing means is rotated; and an outside mixing means disposed around the periphery of said mixing vessel and connected to an outer shaft arranged coaxially with said inner shaft so that the outside mixing means is rotated;

wherein the inside mixing means moves materials of mixture from the bottom of the center of said mixing vessel toward an upper portion of said center and thence toward an upper periphery of said mixing vessel, and then the outside mixing means moves the materials from the upper periphery toward a lower periphery of said mixing vessel and thence toward the bottom of the center of said mixing vessel, the mixer circulating and mixing the materials in said mixing vessel; and wherein said inside mixing means comprises a shaft body connected to said inner shaft and a predetermined number of mixing blade elements which are detachably fixed to said shaft body and overlaid to adjacent mixing blade elements in the axial direction, each mixing blade element being provided with a helical mixing blade piece for mixing and moving said materials, the adjacent mixing blade elements being disposed so that the mixing blade pieces of said adjacent mixing blade elements form one substantially continuous helical blade.

2. The mixer for producing mixture according to claim 1, wherein the adjacent mixing blade elements are disposed so that there is, between adjacent ends of the adjacent mixing blade elements, a predetermined space in the axial direction and a predetermined space in the circumferential direction, an overlapped portion in the circumferential direction and a predetermined space in the axial direction, or an overlapped portion of a predetermined length.

3. The mixer for producing mixture according to claim 1, wherein each of said mixing blade elements has a predetermined number of mixing blade pieces, which are disposed so that corresponding mixing blade pieces of adjacent mixing blade elements each form a substantially continuous helical blade.

4. The mixer for producing mixture according to claim 1, wherein the adjacent mixing blade elements are disposed so that there is, between adjacent ends of said adjacent mixing blade elements, a predetermined space in the axial direction and a predetermined space in the circumferential direction, an overlapped portion in the circumferential direction and a predetermined space in the axial direction, or an overlapped portion of a predetermined length.

* * * * *